US005285501A

United States Patent [19]

Castillo

[11] Patent Number: 5,285,501

[45] Date of Patent: Feb. 8, 1994

[54] VEHICULAR REAR SHELF SPEAKER APPARATUS WITH AUTOMATIC DEODERIZING FLUID DISPENSER

[76] Inventor: Harry A. Castillo, Call Box 2020 Ste. 119, Barceloneta, P.R. 00617

[21] Appl. No.: 948,107

[22] Filed: Sep. 21, 1992

[51] Int. Cl.[5] ..... H04B 1/00

[52] U.S. Cl. ..... 381/86; 181/150; 239/274

[58] Field of Search ..... 381/86, 150, 171, 199, 381/155; 239/274

[56] References Cited

U.S. PATENT DOCUMENTS 4,171,776 10/1979 Pagliaro ..... 239/274
4,453,047 6/1984 Thompson ..... 181/150
4,630,303 12/1986 Tanno ..... 381/86
5,031,220 6/1991 Takagi et al. ..... 381/86

*Primary Examiner*—Forester W. Isen
*Assistant Examiner*—Mark D. Kelly
*Attorney, Agent, or Firm*—Leon Gilden

[57] ABSTRACT

An arcuate speaker is arranged for pivotal mounting relative to a vehicular rear shelf plate in operative communication with a cover plate, wherein pivoting of the speaker in communication with a bottom surface of the rear shelf plate effects pivotal displacement of the cover plate for audible access of the speaker relative to an associated passenger compartment of the vehicle.

1 Claim, 4 Drawing Sheets

10
11
14
16
15
12
6
13
19
18
20
21
17
4
4
25
30
7

13
25
24
22
23

VEHICULAR REAR SHELF SPEAKER APPARATUS WITH AUTOMATIC DEODERIZING FLUID DISPENSER

BACKGROUND OF THE INVENTION

1. Field of the Invention

The field of invention relates to audio equipment, and more particularly pertains to a new and improved vehicular rear shelf speaker apparatus wherein the same permits the masking and subsequent and selective presentation of a speaker relative to a vehicular rear shelf.

2. Description of the Prior Art

Speaker apparatus of various types for use in vehicles is known, and particularly such structure is typically fixedly mounted when utilized within a vehicular rear shelf compartment. Cabinet structure for such mounting is indicated in U.S. Pat. No. 4,924,965 to Murayama, et al.

U.S. Pat. No. 4,837,835 also to Murayama sets forth a further example of cabinetry structure in the fixed mounting of an audio speaker to a vehicular rear shelf plate.

U.S. Pat. No. 4,696,369 to Dodrill and U.S. Pat. No. 4,866,776 to Kasai, et al. set forth further examples of speaker placement within an associated vehicle.

Accordingly, it may be appreciated there continues to be a need for a new and improved vehicular rear shelf speaker apparatus as set forth by the instant invention which addresses both the problems of ease of use as well as effectiveness in construction in permitting the masking of the positioning of the vehicle audio speakers during periods of non-use and in this respect, the present invention substantially fulfills this need.

SUMMARY OF THE INVENTION

In view of the foregoing disadvantages inherent in the known types of speaker apparatus now present in the prior art, the present invention provides a vehicular rear shelf speaker apparatus wherein the same are arranged for pivotal displacement below a vehicular rear shelf plate. As such, the general purpose of the present invention, which will be described subsequently in greater detail, is to provide a new and improved vehicular rear shelf speaker apparatus which has all the advantages of the prior art speaker apparatus and none of the disadvantages.

To attain this, the present invention provides an arcuate speaker arranged for pivotal mounting relative to a vehicular rear shelf plate in operative communication with a cover plate, wherein pivoting of the speaker in communication with a bottom surface of the rear shelf plate effects pivotal displacement of the cover plate for audible access of the speaker relative to an associated passenger compartment of the vehicle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicular rear shelf speaker apparatus which has all the advantages of the prior art speaker apparatus and none of the disadvantages.

It is another object of the present invention to provide a new and improved vehicular rear shelf speaker apparatus which may be easily and efficiently manufactured and marketed.

It is a further object of the present invention to provide a new and improved vehicular rear shelf speaker apparatus which is of a durable and reliable construction.

An even further object of the present invention is to provide a new and improved vehicular rear shelf speaker apparatus which is susceptible of a low cost of manufacture with regard to both materials and labor, and which accordingly is then susceptible of low prices of sale to the consuming public, thereby making such vehicular rear shelf speaker apparatus economically available to the buying public.

Still yet another object of the present invention is to provide a new and improved vehicular rear shelf speaker apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
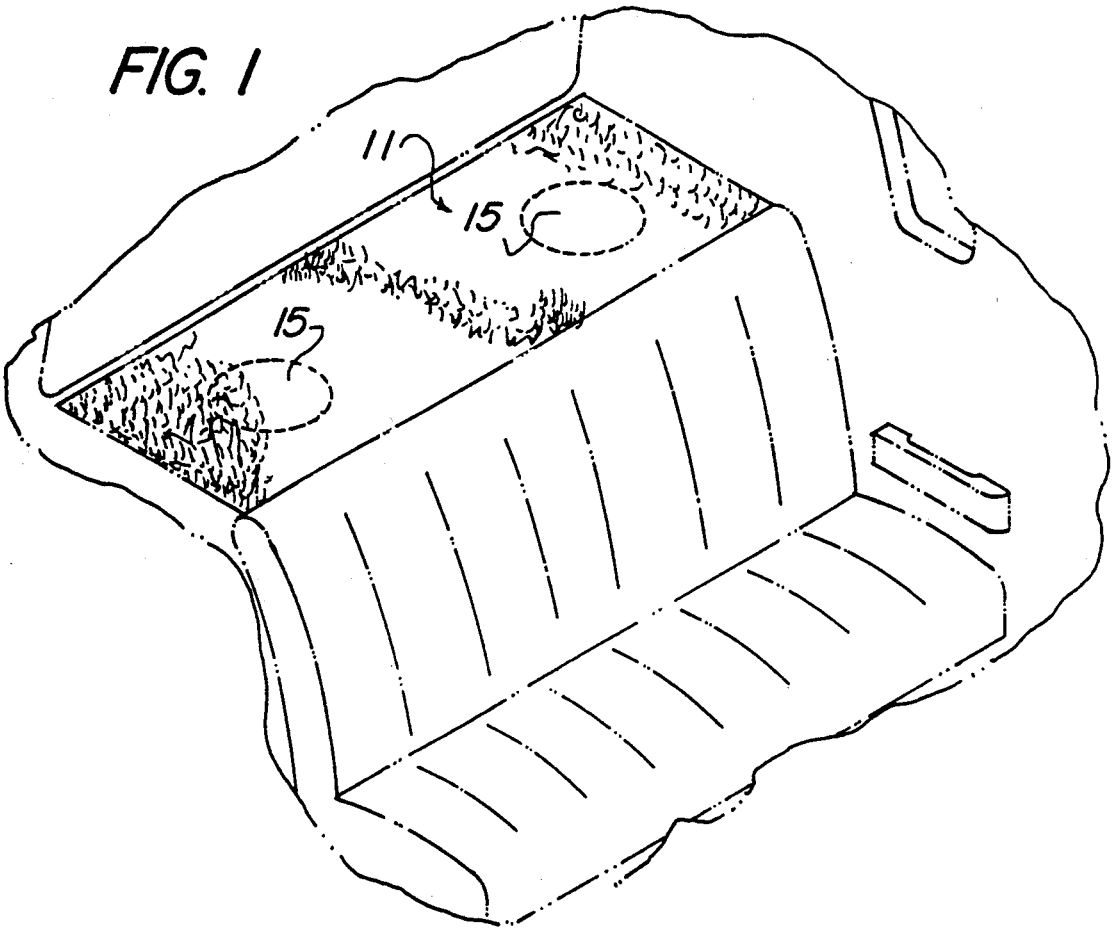
FIG. 1 is an isometric illustration of the instant invention mounted within a rear shelf of a passenger compartment of a vehicle.
Figure 2:
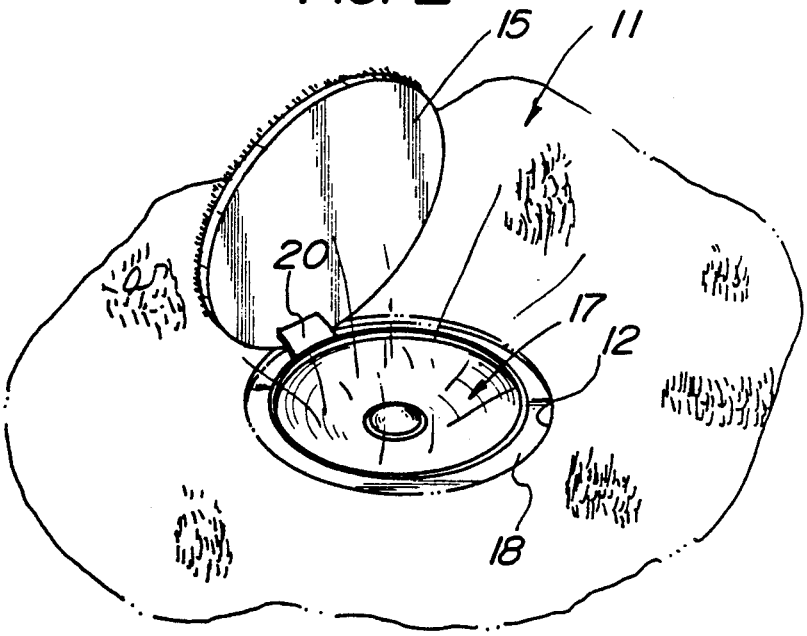
FIG. 2 is an enlarged isometric illustration of the cover plate arranged in a lifted orientation relative to the rear shelf plate.

With reference now to the drawings, and in particular to FIGS. 1 to 11 thereof, a new and improved vehicular rear shelf speaker apparatus embodying the principles and concepts of the present invention and generally designated by the reference numeral 10 will be described.

Figure 3:
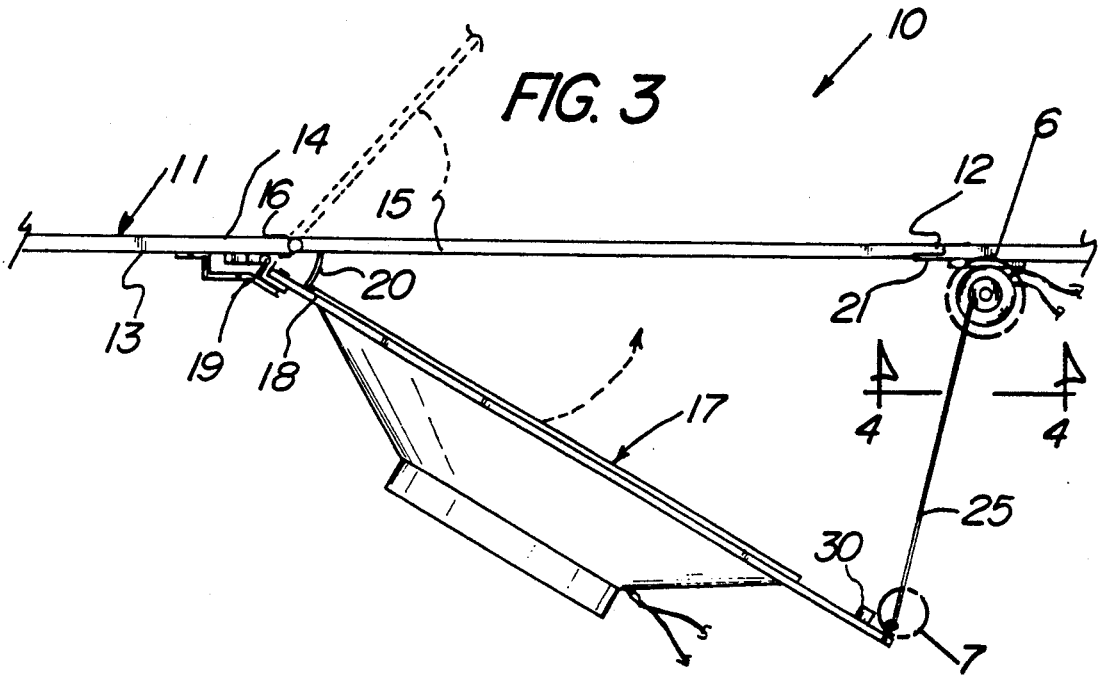
FIG. 3 is an orthographic side view of the vehicle speaker mounted relative to the rear shelf plate.
Figure 4:
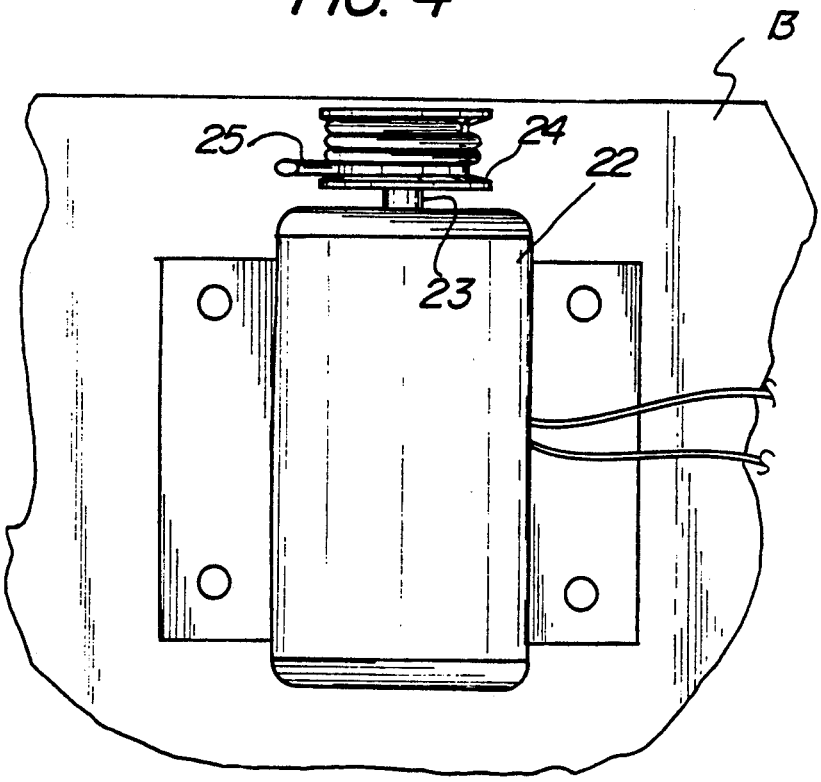
FIG. 4 is an orthographic view, taken along the lines 4—4 of FIG. 3 in the direction indicated by the arrows.
Figure 5:
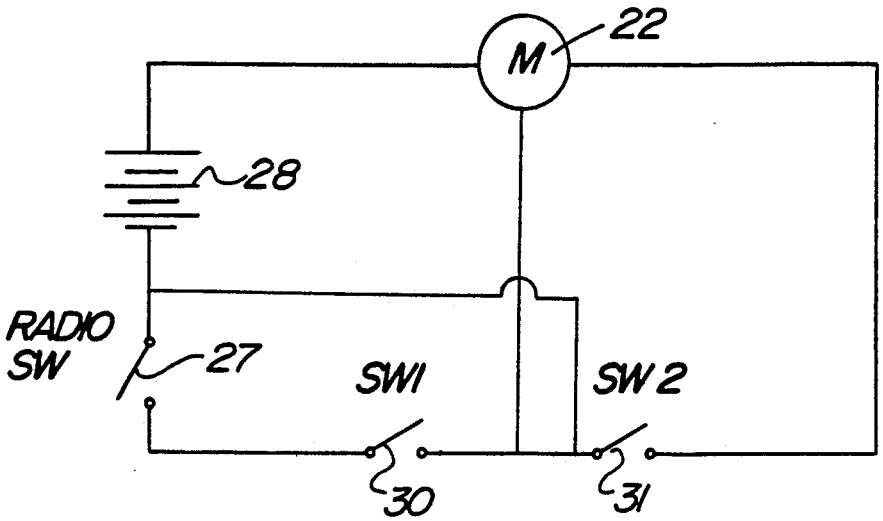
FIG. 5 is a diagrammatic illustration of electrical circuitry utilized by the invention.
Figure 6:
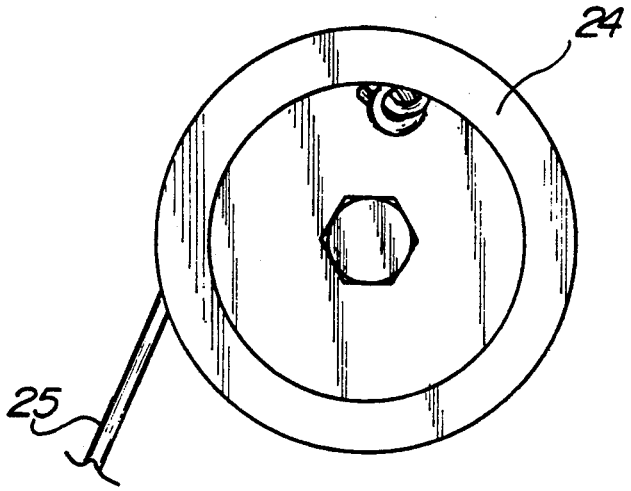
FIG. 6 is an orthographic end view of the cable mounted to the pulley of the associated drive motor, as set forth in section 6 of FIG. 3.
Figure 7:
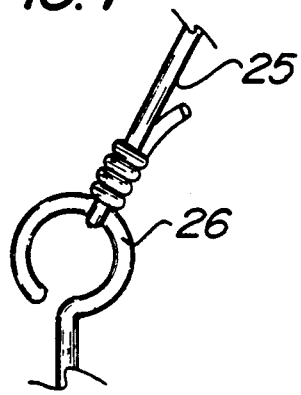
FIG. 7 is an orthographic view of section 7 as set forth in FIG. 3.
Figure 8:
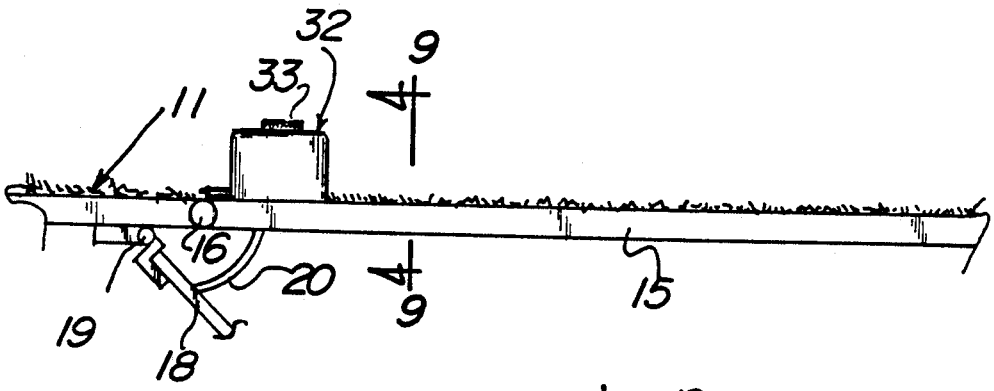
FIG. 8 is an isometric illustration of the invention employing a deodorizing fluid dispenser.
Figure 9:
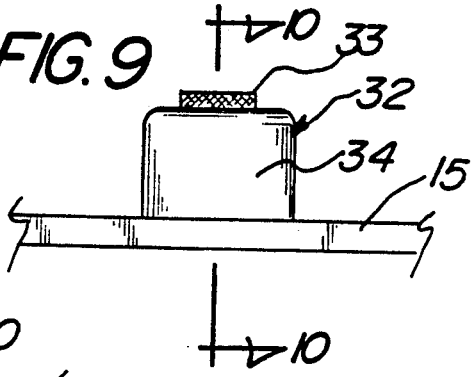
FIG. 9 is an orthographic view, taken along the lines 9—9 of FIG. 8 in the direction indicated by the arrows.
Figure 11:
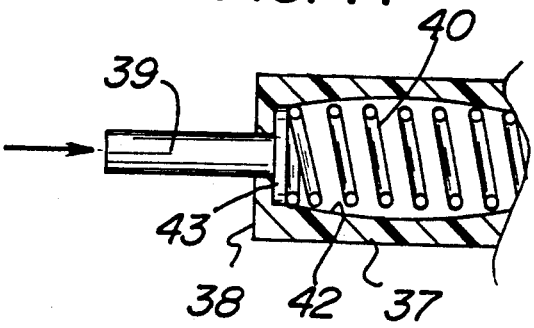
FIG. 11 is an orthographic view of section 11, as set forth in FIG. 10.
Figure 10:
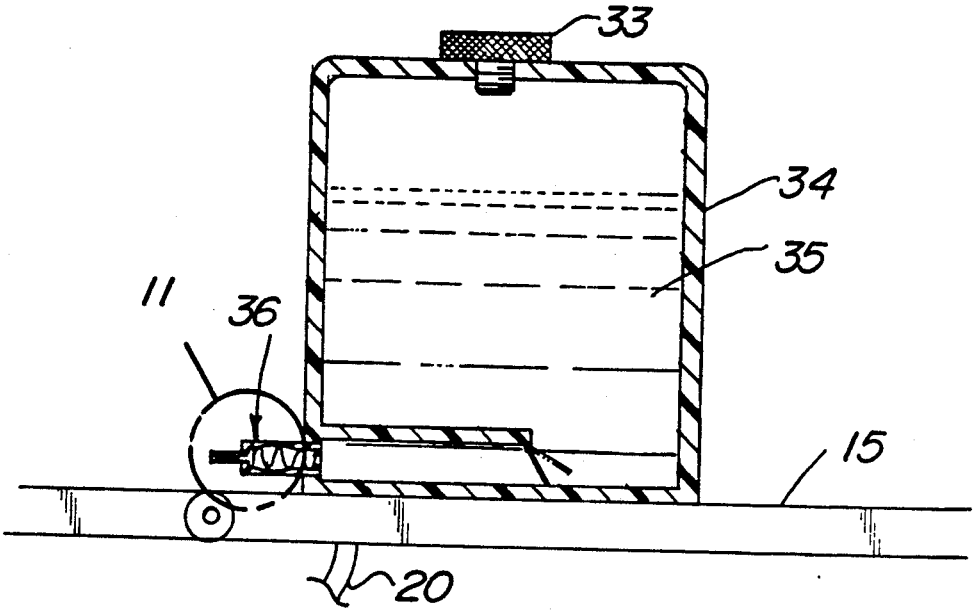
FIG. 10 is an orthographic view, taken along the lines 10—10 of FIG. 9 in the direction indicated by the arrows.

More specifically, the vehicular rear shelf speaker apparatus 10 of the instant invention is arranged for mounting within a vehicular passenger compartment, as indicated in FIG. 1, and more particularly to a vehicular rear shelf plate 11 of that passenger compartment. The rear shelf plate 11 includes at least one plate opening 12, with the shelf plate 11 having a shelf plate bottom surface 13 coextensive with a shelf plate top surface 14. A cover plate 15 is received within the plate opening 12 mounted to a cover plate hinge 16, in a manner as indicated in FIG. 3 for example. An arcuate speaker 17 is mounted to an arcuate speaker hinge 19 that in turn is secured to a peripheral flange 18 of the audio speaker 17. The audio speaker hinge 19 is mounted to the shelf plate bottom surface 13, wherein the cover plate hinge 16 is mounted typically between the shelf plate's top and bottom surface 13 and 14 respectively to effect masking of the hinge or may alternatively be mounted to the shelf plate top surface 14.

An arcuate bridge plate 20 is fixedly mounted between the cover plate 15 and the peripheral flange 18 extending through the plate opening 12 to secure the cover plate and speaker together to effect their unitary pivotment relative to the shelf plate 11. A shelf plate abutment flange 21 oriented below the shelf plate top surface 13 extends into the plate opening 12 and provides for an abutment surface for the cover plate 15 when the cover plate is arranged for coplanar alignment relative to the shelf plate 11 and further functions as an abutment for a first limit switch 30 that is mounted to the peripheral flange 18, in a manner to be discussed in more detail below.

A reversible drive motor 22 is mounted to the shelf plate bottom surface 13 spaced from but in adjacency to the opening 12. The drive motor includes a drive motor output shaft 23 having a pulley 24. The pulley 24 includes a cable 25 having a cable first end secured to the drive motor pulley 24 (see FIG. 6), wherein a second end of the cable 25 includes a fastener such as a hook 26 securing the cable second end to the speaker peripheral flange 18.

A radio switch 27 in operative communication with a conventional vehicular radio, tape player, and the like is mounted in electrical communication with the drive motor 23 through the radio switch 27 and the first limit switch 30 and a second limit switch 31. The second limit switch 31 is mounted in diametrically opposed relationship relative to the first limit switch on opposed side of the plate opening 12 in adjacency to the audio speaker hinge 19, wherein the first and second limit switches 30 and 31 are arranged in normally closed orientation to direct electrical communication with the drive motor, wherein abutment of the first limit switch 30 with the second limit switch abutment flange 31 effects opening of the first limit switch to cease rotation of the pulley 24 relative to the reversible drive motor 23. The second limit switch 31 upon opening of the radio switch 27 effects reversing of the drive motor until contact of the peripheral flange 18 with the second limit switch 31, in a manner as indicated in the FIGS. 3 and 8 for example.

The FIGS. 8-11 indicate the use of a deodorizing container 32 optionally employed by the invention, having a container fill cap 33 and a container side wall 34 to receive a deodorizing fluid 35 therewithin the container 32 for selective dispensing to the shelf plate's top surface 14. A plunger valve 36 mounted through the side wall 34 is positioned in adjacency relative to the shelf plate 11 and the cover plate hinge 16. The plunger valve 36 includes a plunger valve conduit 37 directed into fluid communication with the deodorizing container 32, with the conduit including a conduit end wall 38 having a plunger 39 reciprocatably mounted therethrough. The plunger 39 includes a plunger plate 43 positioned within the plunger valve conduit 37. The plunger valve conduit is of an elliptical cross-sectional configuration within the conduit cavity 42, whereupon a plunger spring 40 is positioned between the plunger plate 43 and the container 32. Pivotment of the deodorizing container 32 mounted to the cover plate 15 effects pivotal displacement of the deodorizing container 32 to effect ultimate abutment of the plunger 39 with the shelf plate's top surface 14, thereby dispensing a predetermined quantity of deodorizing fluid 35 from the deodorizing container 32 for providing for periodic dispensing of deodorizing fluid within the passenger compartment of the associated vehicle.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicular rear shelf speaker apparatus in combination with a vehicular rear shelf plate mounted within a vehicular passenger compartment, wherein the apparatus comprises, a plate opening directed through the rear shelf plate, having a predetermined configuration, wherein the rear shelf plate includes a shelf plate bottom surface spaced from a rear shelf plate top surface, and a cover plate mounted within the plate opening, the cover plate having a cover plate hinge mounted to the rear shelf plate, and an audio speaker having an audio speaker hinge, wherein the audio speaker hinge is mounted to the shelf plate bottom surface, and the audio speaker includes a peripheral flange, with the peripheral flange mounted to the speaker hinge, and the audio speaker and the cover plate are oriented at an acute included angle therebetween, and a bridge plate mounted between the cover plate and speaker peripheral flange, and a reversible drive motor, the reversible drive motor mounted to the shelf plate bottom surface in adjacency to the plate opening, and the drive motor including a drive motor output shaft and a pulley mounted to the output shaft, and a cable, the cable having a first end and a second end, the first end mounted to the pulley, and the cable second end mounted to the peripheral flange in a diametrically opposed relationship relative to the speaker hinge, and a deodorizing container mounted to the cover plate, wherein the deodorizing container includes a container side wall, and the deodorizing container includes a deodorizing fluid contained therewithin, and a plunger valve mounted to the container side wall, the plunger valve having a plunger valve conduit in fluid communication with the deodorizing fluid, and the plunger valve conduit having a conduit end wall, with the conduit end wall having a plunger reciprocatably mounted therewithin, the plunger including a plunger plate positioned within the plunger valve conduit, and a spring interposed between the plunger plate and the container side wall, with the plunger valve conduit having an ellipsoidal cross-sectional configuration, whereupon pivotal displacement of the cover plate relative to the shelf plate top surface effects engagement of the plunger relative to the shelf plate top surface and projection of the plunger plate within the plunger valve conduit.

* * * * *